US005407022A

United States Patent [19]

Scott et al.

[11] Patent Number: 5,407,022

[45] Date of Patent: Apr. 18, 1995

[54] FREE CUTTING GAGE INSERT WITH RELIEF ANGLE

[75] Inventors: Danny E. Scott; Rudolf C. Pessier, both of Houston, Tex.

[73] Assignee: Baker Hughes Incorporated, Houston, Tex.

[21] Appl. No.: 157,952

[22] Filed: Nov. 24, 1993

[51] Int. Cl.[6] ..... E21B 9/36

[52] U.S. Cl. ..... 175/331; 175/374; 175/431

[58] Field of Search ..... 175/331, 426, 431, 374

[56] References Cited

U.S. PATENT DOCUMENTS 3,389,761 6/1968 Ott .
3,727,705 4/1973 Newman .
4,140,189 2/1979 Garner ..... 175/374 X
4,343,372 8/1982 Kinzer .
5,027,913 7/1991 Nguyen .
5,131,480 7/1992 Lockstedt et al. .
5,145,016 9/1992 Estes .

OTHER PUBLICATIONS

Liu et al., An Analysis of Field-Worn TSD Cutting Elements, pp. 23-28 ASME 1992, PED-vol 40, Drilling Technology.

Keshavan et al., Diamond-Enhanced Insert: New Compositions and Shapes pes for Drilling Soft-to-Hard Formations, pp. 577-591, 1993, for Drilling Soft-to--Hard Formations, pp. 577 SEP-IADC Drilling Conference.

*Primary Examiner*—William P. Neuder
*Attorney, Agent, or Firm*—Nydegger & Associates

[57] ABSTRACT

A rolling cone drill bit is disclosed having gage inserts which are installed so as to create a relief angle between the outer surface of each insert and the sidewall of the borehole. Each gage insert only engages the sidewall at a leading edge of the outer surface of the insert.

13 Claims, 5 Drawing Sheets

FREE CUTTING GAGE INSERT WITH RELIEF ANGLE

TECHNICAL FIELD

This invention relates in general to earth boring drill bits with rolling cutters, and in particular to hard inserts used on such drill bits to protect the gage surfaces of the bits.

BACKGROUND OF THE INVENTION

Several types of earth boring drill bits with rolling cutters are known in the art, for use in oil and gas well drilling, water well drilling, and mining. Such drill bits can have a body fitted with one or more rotatable cutters that rotate as the bit is rotated in a borehole. The rotatable cutters can be conical, sometimes called rolling cones, or some other shape. The cutting elements of such bits can be teeth machined or otherwise integrally formed on the cutters, or hard metal inserts mounted on the cutters.

An earth boring drill bit is typically mounted on the lower end of a drill string of pipe, and the pipe is rotated by machinery located at the surface of the drill site. As the pipe is rotated about a substantially vertical axis, the drill bit enters the ground, as weight is applied, and proceeds along a planned path toward a target. The drill path can deviate appreciably from vertical, but for purposes of this disclosure, such deviations are not material.

The drill bit will typically have a number of teeth or cutting inserts which are shaped and positioned to disintegrate the earth formation along the planned drill path, in forming the borehole. The teeth or inserts which disintegrate the formation are generally located in the area of the lower end of the drill bit, which is the front portion of the drill bit as it proceeds through the formation. The borehole formed in the drilling process will have a diameter roughly equal to the diameter of the drill bit. As drilling progresses, the drill bit will proceed along the borehole, and the sides or periphery of the drill bit above the lower end will slide past the sidewall of the borehole.

The formation through which the drill bit passes can often be very hard and abrasive material, so the periphery of the drill bit can suffer significant erosion and wear from contact with the sidewall of the borehole. For this reason, it is common to protect the peripheral surfaces of the drill bit from erosion and wear by several means. The surfaces can be protected by hardening the steel or by depositing very hard material called hardfacing, such as tungsten carbide, over the surfaces. Some surfaces are protected by installing buttons or inserts of very hard and abrasion resistant material in holes in the surface, with an end of each insert either substantially flush with the surface or raised slightly above the surface. The use of such inserts can also assist in maintaining the full design diameter of the borehole, as the primary cutting inserts or teeth wear down. It is important to maintain the full gage of the hole to permit eventual insertion of casing and to avoid drag and damage on the following bit.

These gage inserts can be made of tungsten carbide, natural diamond, synthetic diamond, or composites of these materials. They can have an outer surface ground to conform to the shape of the peripheral surface to be protected, or they can have an outer surface with another contour, such as flat. A peripheral surface on the drill bit which is protected by hard inserts is generally designed to be close to the borehole wall at or near the full designed diameter, or full gage. These surfaces are therefore typically referred to as gage surfaces of the bit.

The gage surface can be an inclined surface at the base of a rotatable cutter. If the rotatable cutter is conical, the gage surface will typically be a frustum of a cone, called a frusto-conical surface. In any case, the gage surface is one which is designed to generally align with the sidewall of the borehole, as the drill bit rotates. A gage surface on a rotatable cutter would only align with the sidewall over a narrow area where the cutter contacts the sidewall, in a generally sliding fashion, as the drill bit rotates and advances.

When a hard material insert is used on the gage surface of a drill bit in hard and abrasive formations, it often happens that the insert experiences rapid deterioration or even premature failure. In a tungsten carbide insert, the deterioration usually takes the form of heavy wear and heat checking as the insert conforms to the sidewall of the borehole. However, in the harder inserts, such as those containing diamond materials, the insert will not wear down. It will instead continue to stick out from the gage surface, causing it to be severely loaded. This results in overheating, checking, cracking, chipping, and eventual failure. This deterioration usually initially takes the form of heat checking, often followed by cracking, on the outer surface of the insert, localized in the portion of the surface that can be called the "trailing" area as opposed to the "leading" area. The area characterized as the leading area is that area of the outer surface or face of the insert that first engages the sidewall of the borehole as the bit rotates. The area characterized as the trailing area is that area of the outer surface of the insert that lies on the opposite side of the outer surface from the leading area. Similarly, the edge formed at the intersection of the outer surface and cylindrical body of the gage insert that first engages the sidewall is commonly called the leading edge and the opposite edge is called the trailing edge. This edge may be a chamfer connecting the outer surface and the cylindrical surface.

The leading edge of the insert has an angular orientation about the axis of the insert that is influenced by a number of factors including weight on bit, bit r.p.m., and others. The combination of these factors will result in a characteristic angular orientation of the leading edge of the insert. This angular orientation will typically vary from alignment with the lowermost edge of the insert, as the bit hangs vertically, to an orientation that can be rotated as much as 90 degrees from the vertical, in the direction of bit rotation. The direction of bit rotation is typically clockwise, as viewed from the top of the borehole. Therefore, in other words, depending upon a number of factors, if one views the outer end surface of the gage insert on a vertical bit, the gage insert will typically first engage the sidewall somewhere in the lower left hand quadrant of the surface.

Heat checking has frequently been observed in the trailing area of the gage insert outer surface. It can progress to cracking and rapid erosion or chipping away of the insert material. It is thought that this damage results from the generation of excessive heat by the sliding under high load of the entire outer surface of the insert along the sidewall of the borehole. In other words, since the gage insert in known drill bits is installed with its outer surface generally aligned with the sidewall of the borehole, excessive friction generates excessive heat at the surface of the insert. This excessive heat generation and the resultant heat damage are more pronounced in the trailing area of the insert surface, probably since the material being crushed by the leading half of the insert is extruded underneath the insert and further increases the contact stresses as the insert advances. As the insert is exiting its contact with the borehole wall, excessive tensile forces act on the trailing edge, causing propagation of the heat cracks. In addition to heat checking of the insert and associated damage, the excessive heat generated can have deleterious effects on other nearby components of the drill bit, such as the elastomeric seals in a rotatable cutter.

It is an object of the present invention, therefore, to develop a drill bit which will not develop excessive heat and the related damage in the vicinity of the gage surfaces, by improving the interaction between the gage inserts and the sidewall of the borehole. It is a further object of the present invention to develop a drill bit which will have gage inserts that are not aligned parallel to and substantially flush with the sidewall of the borehole being drilled, but which will have the trailing area of the outer surface of the insert recessed from the sidewall. It is a still further object of the present invention to develop a drill bit which will avoid the aforementioned problems of insert failure, and which will be relatively cost effective to manufacture.

SUMMARY OF THE INVENTION

The present invention is a drill bit which has gage inserts which have outer surfaces that do not align with the sidewall of the borehole being drilled. In a preferred embodiment, for exemplary purposes only, a drill bit of the rotatable cutter type has three conical rotating cutters mounted on a bit body. Each of the rotatable cutters has a frusto-conical gage surface near the base of the cone, which generally aligns with the sidewall of the borehole as the cutter rotates. Each of these gage surfaces has a plurality of gage inserts installed in holes provided in the gage surface. Each gage insert has the leading edge of its outer surface slightly closer to the borehole wall than its trailing edge, so that the entire outer surface of the gage insert does not slide along the sidewall of the borehole. The outer surface is instead slightly angled away from the sidewall. This results in a line or arc of contact between the sidewall and the leading edge of the insert, while a relief angle exists between the remainder of the surface of the insert and the sidewall. This relief angle results in a free cutting insert, with attendant improvement in removal of formation cuttings, increased insert durability, and improved dissipation of heat.

The leading edge can be raised relative to the trailing edge by using a typical cylindrical insert installed in a hole that is canted with respect to the gage surface. Alternatively, the leading edge can be caused to project relative to the trailing edge by forming a canted surface on the outer end of the insert and installing the insert in a selected angular orientation in a hole drilled normal to the gage surface. The extended edge of the insert can protrude above the gage surface, or it can be at or slightly below the surface. If the extended edge does not protrude above the gage surface, then the gage surface will have to wear slightly before the gage insert comes into play. The angular orientation of the extended edge of the insert is aligned with the angular location of the leading edge of the insert.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
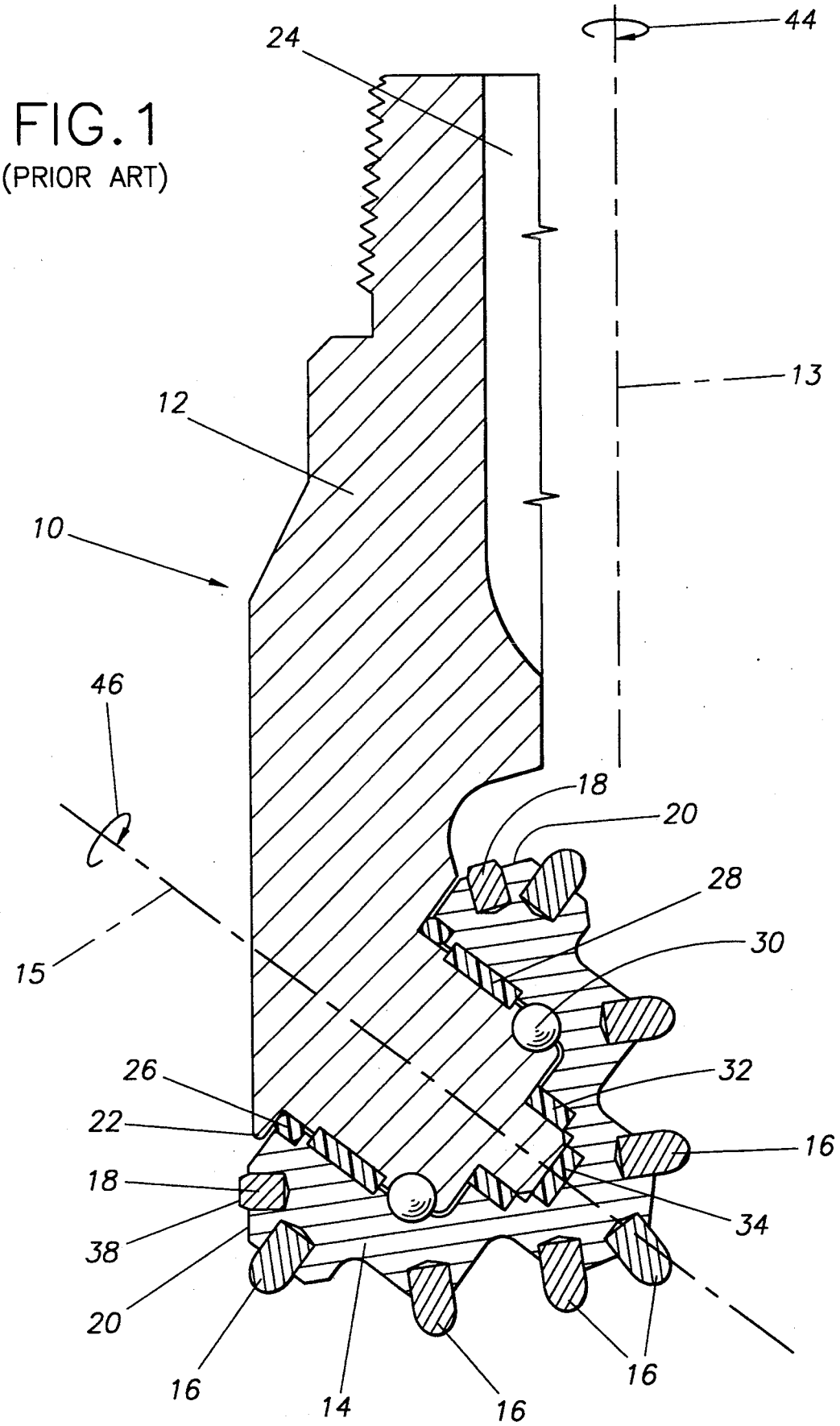
FIG. 1 (PRIOR ART)
FIG. 1 is a partial section view of a typical rolling cone earth boring drill bit, showing the relevant parts for purposes of disclosure of the present invention.

Referring initially to FIG. 1, an earth boring drill bit 10 of the rotatable cutter, or rolling cone, type is shown. Drill bit 10 is threaded to one or more drill collars (not shown) which are threaded to a drill pipe (not shown). As the drill pipe is rotated by machinery at the surface of the drill site, drill bit 10 rotates about its central axis 13 in a clockwise direction when viewed from above, as indicated by arrow 44. Drill bit 10 has a body 12 that is composed of three sections essentially like the one shown. The three sections are welded together. Each section of body 12 supports a conical shaped rotatable cutter 14, sometimes called a rolling cone. Formation disintegrating inserts 16 are mounted on the outside surface of cutter 14. Inserts 16 are made of a hard material such as tungsten carbide or diamond or composites thereof, and they are pressed or brazed into receiving holes drilled into cutter 14.

Cutter 14 is rotatably mounted on a pin or journal of one of the three sections of body 12, with cutter axis 46 angled generally downwardly and inwardly toward the center of bit 10. Cutter 14 rotates about axis 46 in a counter-clockwise direction when viewed from outside the bit, as indicated by arrow 46. Drilling fluid is pumped from the surface of the drill site down through the drill pipe, through fluid passage 24 and out through a nozzle (not shown). The drilling fluid then flows out through the bottom of drill bit 10 and around the outside of the bit, and then back to the surface via the borehole.

Cutter 14 is typically held in place on the body 12 by a plurality of ball bearings 30. Radial and axial thrust are absorbed by bearings 28, 32, 34. Lubrication can be supplied to the bearings by apparatus omitted from this figure for clarity. The lubricant is sealed in the bit and drilling fluid is excluded by seal 26, usually having one or more components of an elastomeric material. Shirt tail 22 is an extension of the side of bit 10 which extends partially over the base of cutter 14, assisting in the exclusion of drilling fluid and associated drilling detritus from the cutter bearings. Hardfacing material is typically applied to shirt tail 22 to protect it from wear by the sidewall of the borehole and associated drilling detritus.

Gage surface 20 is a frusto-conical surface near the base of the conical cutter 14. The angle of gage surface 20 is designed to align gage surface 20 with the sidewall of the borehole as cutter 14 rotates about its mounting on bit body 12. A plurality of hard gage inserts 18 are mounted in holes in gage surface 20, with an outer surface 38 positioned at the design diameter of the borehole. As the bit 10 rotates, cutters 14 rotate, continually causing gage inserts 18 to rotate past the sidewall of the borehole, maintaining the borehole at its design diameter and protecting gage surface 20 from excessive erosion. Gage inserts 18 are typically cylindrical elements of a very hard and abrasion resistant material, such as tungsten carbide or diamond or composites thereof, and they are pressed or brazed into holes in gage surface 20. The mounting holes are typically drilled normal to gage surface 20, and the outer surface 38 of each gage insert 18 is either substantially flush with or slightly projecting from gage surface 20. Outer surface 38 can have any desired shape, but it is typically either flat or ground to match the contour of gage surface 20.

Figure 2:
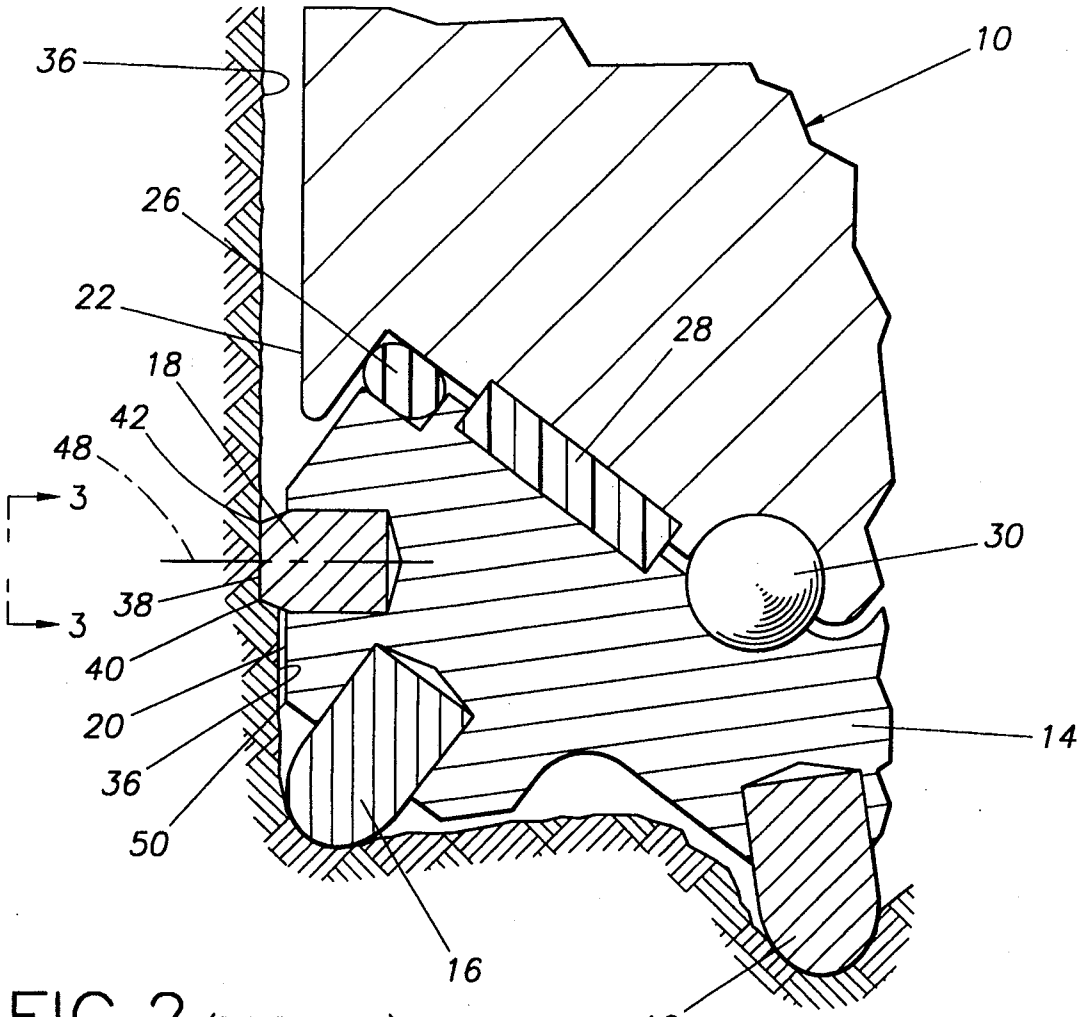
FIG. 2 (PRIOR ART)
FIG. 2 is a partial section view of the gage area of a rolling cone drill bit, as known in the prior art, showing a gage insert aligned with the sidewall of the borehole.

Referring now to FIG. 2, a closer view of the gage surface 20 is shown in a drill bit 10 currently known in the art. A row of cutting teeth 16, called the heel row, next to the heel 50, disintegrate the bottom of the borehole and establish the approximate diameter of the borehole. As the teeth in the heel row wear down, the sidewall 36 begins to approach the gage surface 20 of cutter 14. As cutter 14 advances, gage inserts 18 engage the sidewall 36 of the borehole and remove a thin layer of material from the sidewall 36, thereby maintaining the design diameter of the borehole. In the particular bit shown in FIG. 2, gage insert 18 first engages the sidewall 36 of the borehole at leading edge 40, which is centered at the lowermost point on insert outer surface 38. Trailing edge 42 is therefore centered approximately at the uppermost point on outer surface 38. Gage insert 18 is shown with its axis 48 normal to gage surface 20, so outer surface 38 is approximately flush with the sidewall 36 of the borehole. Outer surface 38 can be essentially flush with gage surface 20, or it can project slightly as shown. If outer surface 38 is manufactured flush with gage surface 20, then gage surface 20 will have to wear slightly before gage inserts 18 begin to remove material from the sidewall 36. In some bit designs, leading edge 40 will be centered at an angular orientation more toward the direction of rotation of drill bit 10. The present invention, as explained later, will apply equally well to bits having different angular orientations of leading edge 40.

In currently known bits, as shown in FIG. 2, gage insert 18 will generate excessive heat and suffer heat checking and other damage in the vicinity of the trailing edge 42. The location of trailing edge 42 can best be illustrated by reference to FIG. 3, which is a view of the outer surface 38 of gage insert 18 on the bit shown in FIG. 2. Reference lines are shown to indicate the general vicinities of the leading area 38L and the trailing area 38T of outer surface 38 of gage insert 18. It is trailing area 38T that typically suffers heat checking and other damage in currently known bits. The reference lines are not intended to accurately define the limits of the leading and trailing areas, because these areas can be of varying sizes and orientation in different bits, and they can even change as a given bit is operated with varying r.p.m., rate of penetration, or weight on bit, for instance.

Figure 3:
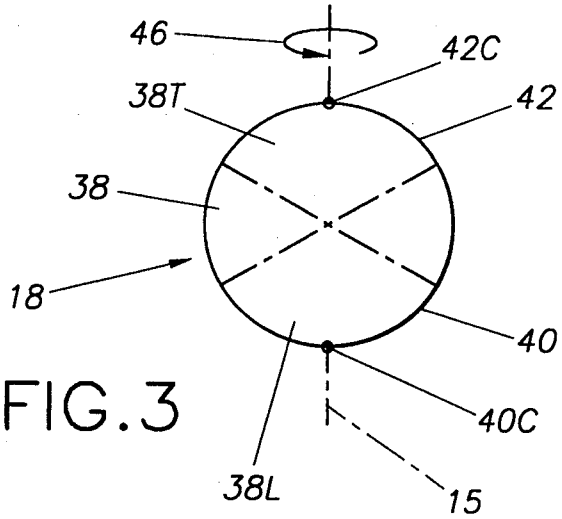
FIG. 3 is an elevation view of the outer end surface of a gage insert, taken as shown by the arrows 3—3 in FIG. 2, showing the leading and trailing areas of the insert surface.

As seen in FIG. 3, leading area 38L is generally bounded by leading edge 40, centered approximately at point 40C. Similarly, trailing area 38T is located generally opposite from area 38L, and it is bounded by trailing edge 42, centered approximately at point 42C. It can be seen that, for this particular bit, a line drawn including points 40C and 42C will intersect axis 46 of cutter 14. Stated differently, a plane established by cutter axis 46 and the center of outer surface 38 would contain points 40C and 42C.

Figure 4B:
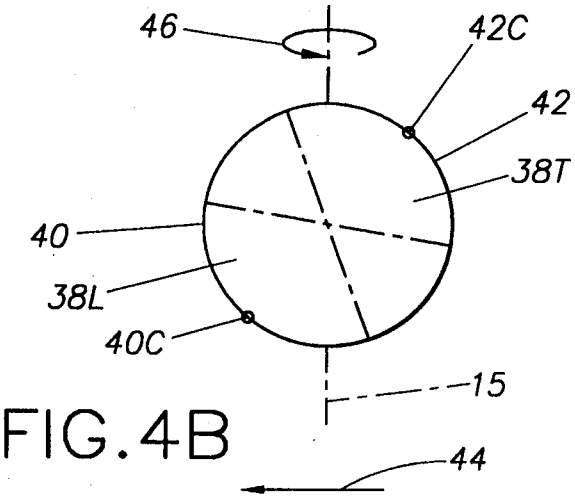
FIG. 4B is an elevation view similar to the view shown in FIG. 3, showing a different angular orientation of the leading and trailing areas.
Figure 4A:
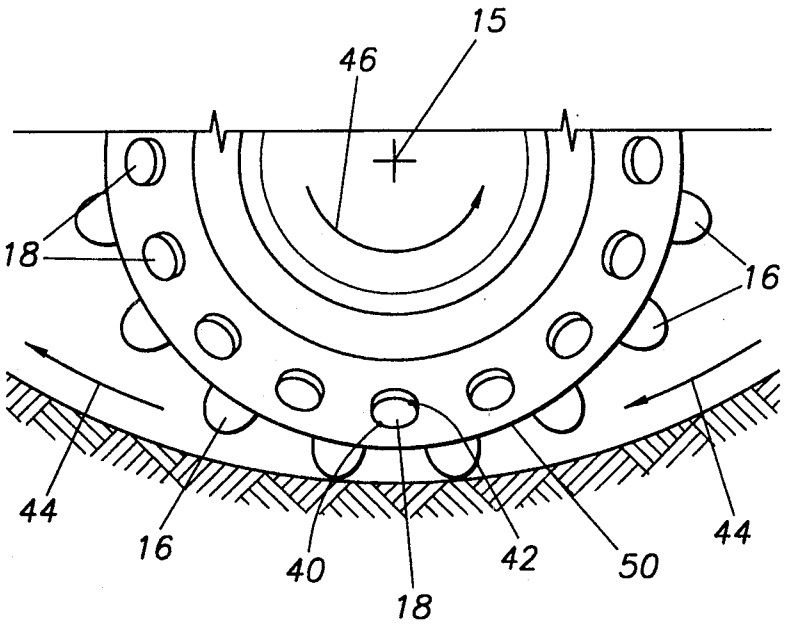
FIG. 4A is an elevation view of a portion of the gage surface of a bit having a different angular orientation of the leading edge.

For another bit, as seen in FIGS. 4A and 4B, the leading edge 40 which bounds leading area 38L can be centered at an angular orientation more toward the direction of rotation of drill bit 10, as shown by arrow 44. In fact, in some bits, the center 40C of leading edge 40 can be rotated in this direction so far that a line containing points 40C and 42C would be almost parallel to arrow 44. It can be seen that, in the bit represented in FIGS. 4A and 4B, a plane established by cutter axis 46 and the center of outer surface 38 would be oblique to a line established by points 40C and 42C.

Figure 5:
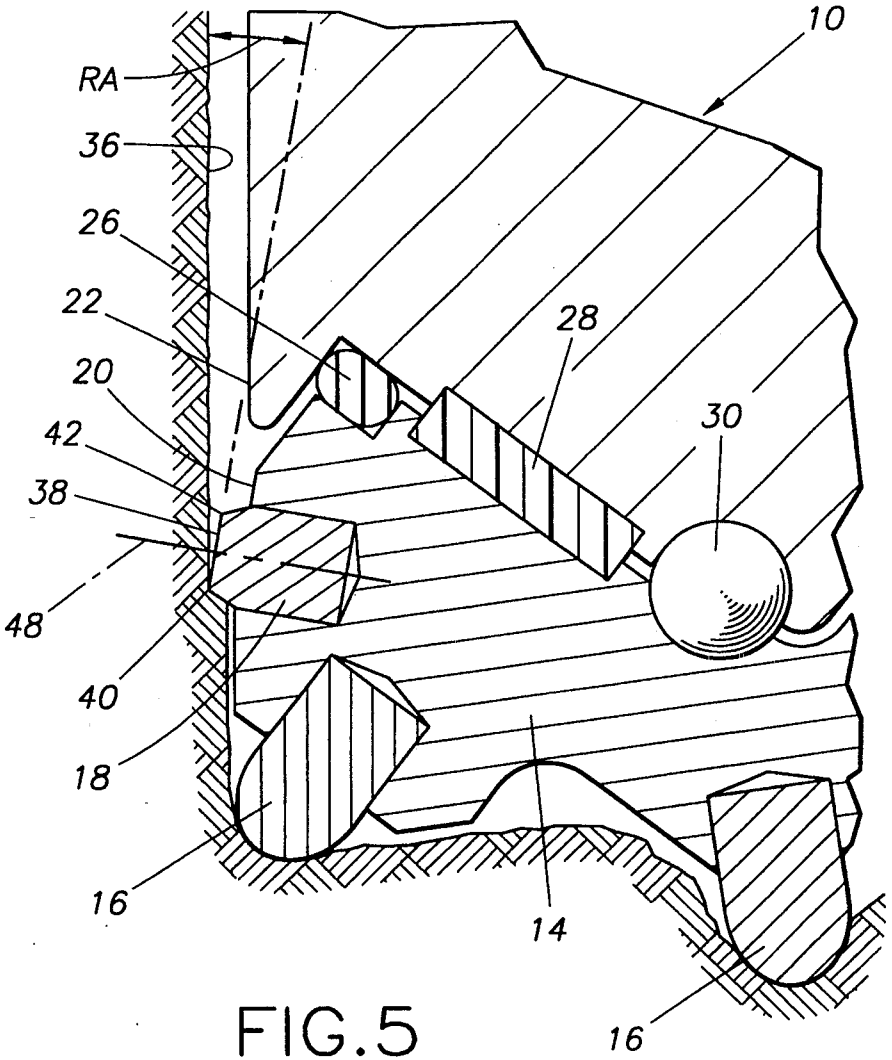
FIG. 5 is a partial section view of the gage area of a rolling cone drill bit according to the present invention, showing a protruding leading edge and a recessed trailing edge on the gage insert.

Referring now to FIG. 5, a view is shown of the gage surface 20 of a drill bit 10 embodying the present invention. Gage insert 18 is mounted in a hole in gage surface 20, with axis 48 of gage insert 18 canted away from perpendicular to sidewall 36. The angle by which axis 48 differs from perpendicular to sidewall 36 is also the relief angle RA between outer surface 38 of insert 18 and the sidewall 36. Relief angle RA is preferably approximately 5 degrees, but it could vary between about 2 degrees and 20 degrees in particular bits and in particular applications. Establishment of relief angle RA causes leading edge 40 to protrude slightly relative to the rest of outer surface 38, and it causes trailing edge 42 to be recessed slightly relative to the rest of outer surface 38. This results in the generation of significantly less heat than currently known designs, accompanied by elimination of heat checking and other related damage in the trailing area 38T.

Gage surface 20 can be slightly relieved from the sidewall 36 as shown, or it can remain parallel as known in the prior art, as long as outer surface 38 of gage insert 18 is arranged with the requisite relief angle RA. Referring again to FIG. 3, if the particular bit 10 has a leading edge 40 of gage insert 18 oriented at the lowermost point of the insert, a drill bit in accordance with the present invention would have point 40C slightly protruding toward the viewer, and point 42C would be slightly recessed away from the viewer. In the type of drill bit represented in FIGS. 4A and 4B, again, point 40C would be slightly protruding toward the viewer, and point 42C would be slightly recessed away. Still as before, in FIG. 3, a plane established by axis 46 and the center of surface 38 would contain a line established by points 40C and 42C. In this design, a plane containing the relief angle RA would lie substantially parallel to the axis of the borehole. In FIGS. 4A and 4B, a plane established by axis 46 and the center of surface 38 would be oblique to a line established by points 40C and 42C. In this design, a plane containing the relief angle RA would obliquely intersect the axis of the borehole.

Figure 6:
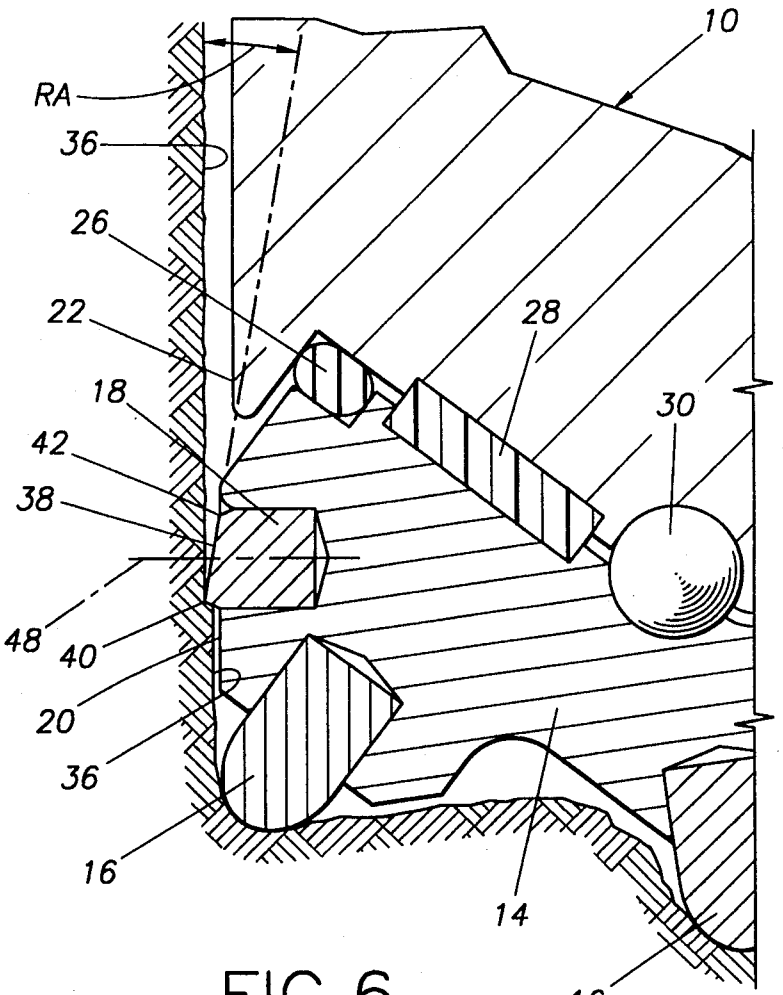
FIG. 6 is a partial section view of the gage area of a rolling cone drill bit according to the present invention, showing an alternate embodiment.

Referring to FIG. 6, an alternate embodiment of the present invention is shown. Leading edge 40 is still protruding relative to trailing edge 42, creating a relief angle RA as discussed before. In this embodiment, this relationship is established by manufacturing gage insert 18 with an appropriately canted outer surface. This permits installation of gage insert 18 in a hole normal to gage surface 20. As discussed before, leading edge 40 can be centered at the lowermost point on surface 38, as shown, or leading edge 40 can be rotated to an angular orientation more in the direction of rotation of drill bit 10.

Figure 7:
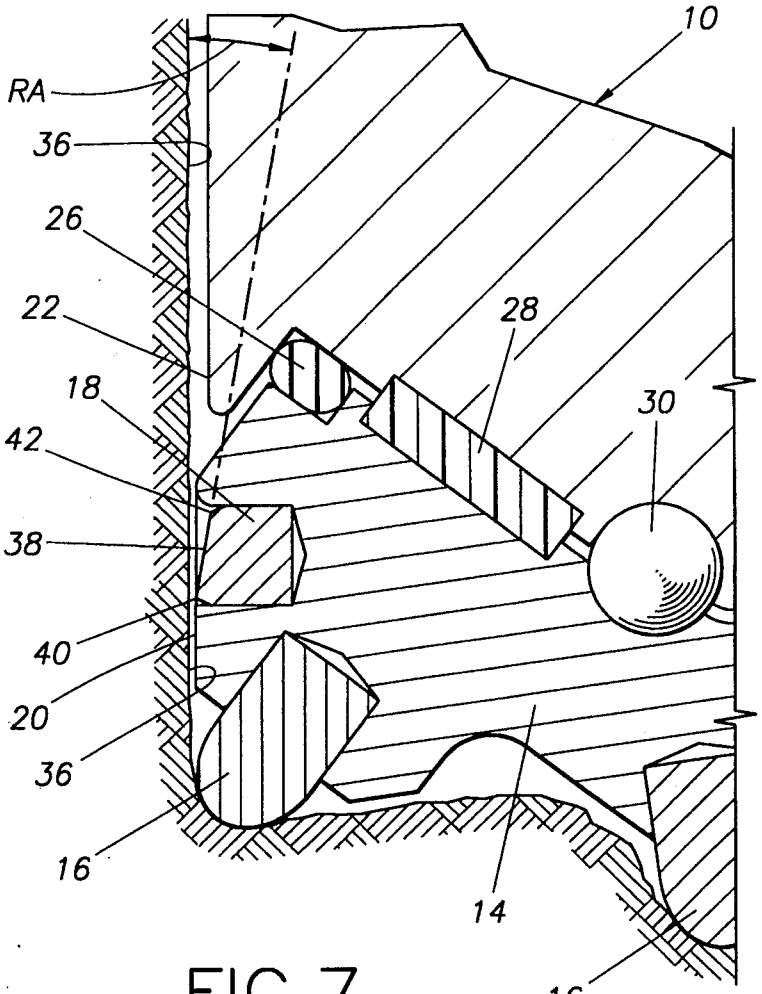
FIGS. 7 through 9 are partial section views of the gage area of a rolling cone drill bit according to the present invention, showing alternative ways of establishing the relief angle.
Figure 9:
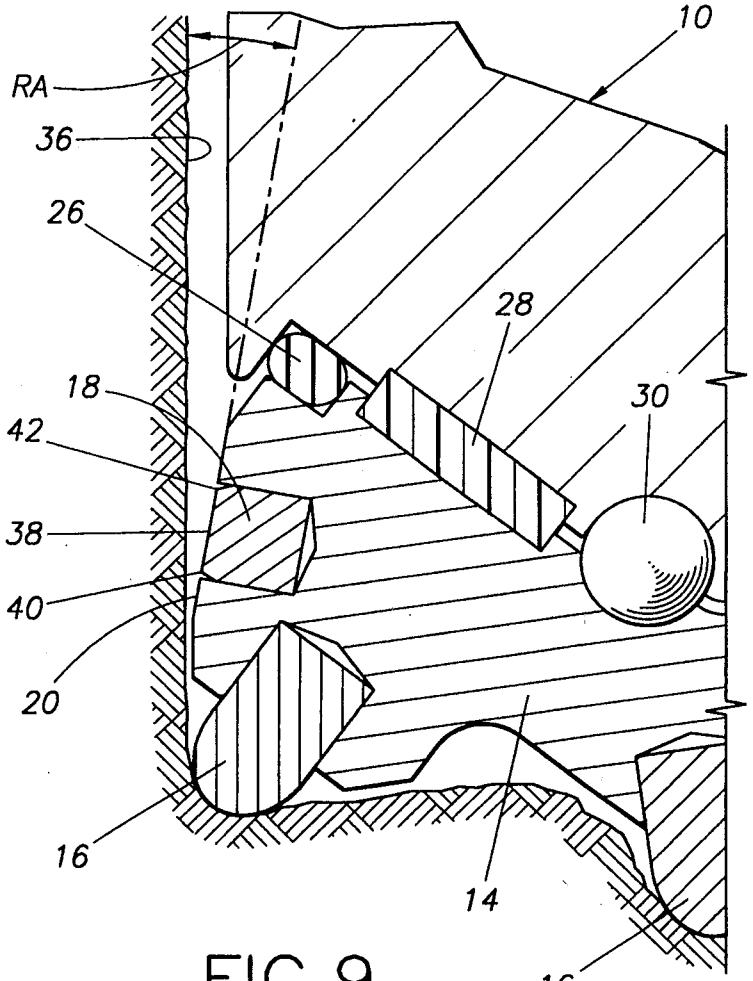
Figure 8:
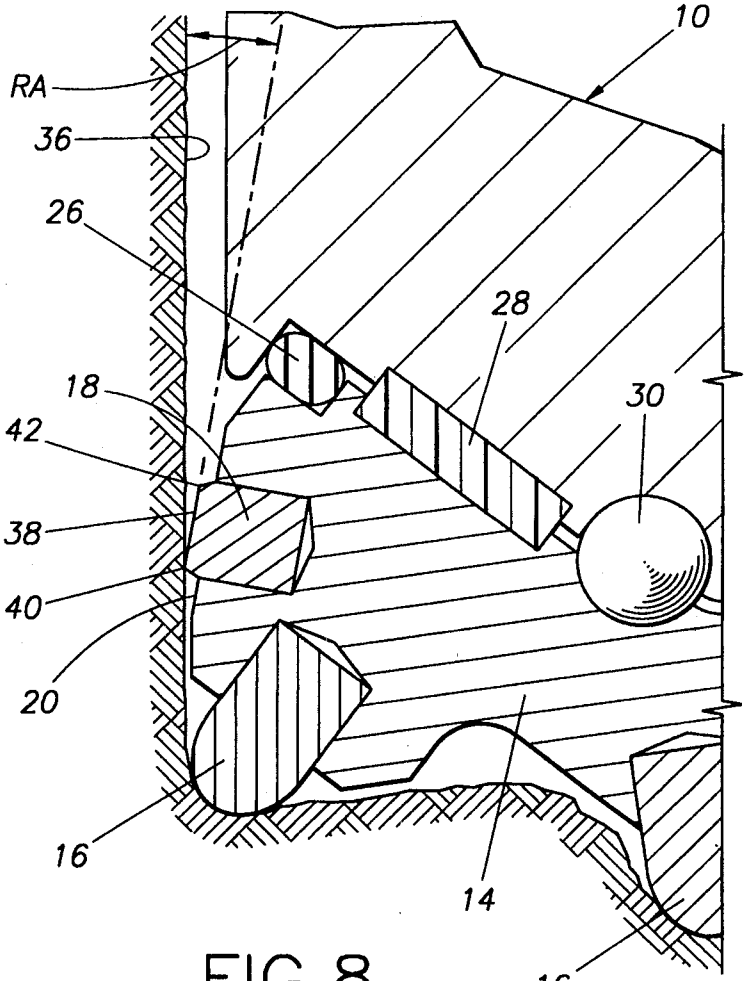

FIGS. 7, 8, and 9 show additional alternative embodiments of the present invention, illustrating several ways in which the relief angle can be established. Gage insert 18 can be recessed within a hole in gage surface 20 as in FIG. 7, with leading edge 40 approximately tangent to the surface. Gage insert 18 can protrude from gage surface 20, and the gage surface can be angled to match the relief angle RA, as in FIG. 8. Still further, gage surface 20 can be angled to match relief angle RA, and gage insert 18 can be recessed flush with the surface, as shown in FIG. 9.

Tests have been run to demonstrate the reduction in tangential and axial forces necessary to cut into a hard formation, which can be achieved by the present invention. The test apparatus rotated a single cylindrical gage insert through a formation material at a known rate of rotation and a known rate of penetration. Instrumentation measured the required forces in the axial and tangential directions, relative to the cylindrical gage insert. An insert oriented with its outer surface 38 flush with the formation wall was found to require approximately four times the axial force and twice the tangential force required by an identical insert oriented at a 5 degree relief angle. This significant reduction in applied forces is accompanied in the drilling environment by a comparable reduction in the friction forces between the insert 18 and the sidewall 36 of the borehole. Such a reduction in friction results in a comparable reduction in heat generation.

While the particular Free Cutting Gage Insert With Relief Angle as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. An improved rolling cone drill bit, for drilling a borehole having a sidewall, said drill bit comprising:

an insert mounted on a gage surface of said drill bit for maintaining full gage diameter of the borehole;

a substantially flat outer surface on said insert for engaging the sidewall of the borehole in sliding contact during rotation of said drill bit;

a leading edge on said outer surface of said insert, said leading edge being at the front of said outer surface as said outer surface engages the sidewall of the borehole during drilling; and a trailing edge on said outer surface of said insert, said trailing edge being at the rear of said outer surface as said outer surface engages the sidewall of the borehole during drilling, said trailing edge having a center point spaced farther from the sidewall of the borehole than any other point on said outer surface, thereby establishing a relief angle between said outer surface and the sidewall of the borehole;

wherein said leading edge lies ahead of a radial reference plane containing the axis of the borehole, in the direction of rotation of said drill bit.

2. An improved rolling cone drill bit as claimed in claim 1, further comprising:

a drill bit body;

a rotating cutter mountable on said drill bit body; and a gage surface on said rotating cutter, said gage surface substantially aligning with the sidewall of the borehole as said cutter rotates;

wherein said gage insert is mountable on said gage surface of said rotating cutter.

3. An improved rolling cone drill bit as claimed in claim 2, further comprising:

a plurality of gage inserts mountable on said gage surface;

an outer surface on each of said gage inserts;

a leading edge on each of said outer surfaces for contacting the sidewall of the borehole; and a trailing edge on each of said outer surfaces, spaced farther from the sidewall of the borehole than said leading edge.

4. An improved rolling cone drill bit as claimed in claim 1, wherein said relief angle is between about 2 degrees and about 20 degrees.

5. An improved rolling cone drill bit as claimed in claim 4, wherein said relief angle is about 5 degrees.

6. An improved rolling cone drill bit, for drilling a borehole having a sidewall, said drill bit comprising:

a drill bit body;

a cutter rotatably mounted on said body;

a gage surface on said cutter, said gage surface substantially aligning with the sidewall of the borehole as said drill bit rotates;

a gage insert mounted on said gage surface;

an outer surface on said gage insert for engaging the sidewall of the borehole in sliding contact during drilling;

a leading edge on said outer surface of said insert, said leading edge being at the front of said outer surface as said outer surface engages the sidewall of the borehole during drilling; and a trailing edge on said outer surface of said insert, said trailing edge being at the rear of said outer surface as said outer surface engages the sidewall of the borehole during drilling, said trailing edge having a center point which is recessed away from the sidewall of the borehole farther than any other point on said outer surface, thereby establishing a relief angle between said outer surface and the sidewall of the borehole;

wherein said leading edge lies ahead of a radial reference plane containing the axis of the borehole, in the direction of rotation of said drill bit.

7. An improved rolling cone drill bit as claimed in claim 6, wherein said relief angle is between about 2 degrees and about 20 degrees.

8. An improved rolling cone drill bit as claimed in claim 6, wherein said relief angle is about 5 degrees.

9. An improved rolling cone drill bit, for drilling a borehole having a sidewall, said drill bit comprising:

a drill bit body;

a plurality of cone shaped cutters rotatably mounted on said body, with the apex of each of said cutters oriented generally toward the longitudinal axis of said body;

a frusto-conical gage surface on each of said cutters, near the base of each of said cutters, said gage surfaces substantially aligning with the sidewall of the borehole as said drill bit rotates;

a plurality of substantially cylindrical gage inserts mounted on each of said gage surfaces;

an outer flat end on each of said gage inserts for engaging the sidewall of the borehole in sliding contact during drilling;

a leading edge on each of said outer ends of said inserts, said leading edge being at the front of said outer flat end as said outer flat end engages the sidewall of the borehole during drilling; and a trailing edge on each of said outer ends of said inserts, said trailing edge being at the rear of said outer flat end as said outer flat end engages the sidewall of the borehole during drilling, said trailing edge having a center point which is recessed away from the sidewall of the borehole farther than any other point on said outer flat end, thereby establishing a relief angle between each of said outer ends and the sidewall of the borehole;

wherein said leading edge lies ahead of a radial reference plane containing the axis of the borehole, in the direction of rotation of said drill bit.

10. An improved rolling cone drill bit as claimed in claim 9, wherein said relief angle is established by manufacturing each of said gage inserts with said outer flat end being at an oblique angle to the longitudinal axis of said gage insert.

11. An improved rolling cone drill bit as claimed in claim 9, wherein said relief angle is between about 2 degrees and about 20 degrees.

12. An improved rolling cone drill bit as claimed in claim 11, wherein said relief angle is approximately 5 degrees.

13. An improved rolling cone drill bit for drilling a borehole having a sidewall, said drill bit comprising:

a drill bit body;

a plurality of cone shaped cutters rotatably mounted on said body, with the apex of each of said cutters oriented generally toward the longitudinal axis of said body;

a frusto-conical gage surface on each of said cutters, near the base of each of said cutters, said gage surfaces substantially aligning with the sidewall of the borehole as said drill bit rotates;

a plurality of substantially cylindrical gage inserts mounted on each of said gage surfaces;

an outer flat end on each of said gage inserts for engaging the sidewall of the borehole;

a leading edge on each of said outer ends; and a trailing edge on each of said outer ends, with said trailing edge being recessed relative to said corresponding leading edge, thereby establishing a relief angle between each of said outer ends and the sidewall of the borehole;

wherein said relief angle is established by installing each of said gage inserts in an angled hole in said gage surface.

* * * * *